US006420827B1

(12) United States Patent
Lee et al.

(10) Patent No.: US 6,420,827 B1
(45) Date of Patent: Jul. 16, 2002

(54) FIELD EMISSION DISPLAY

(75) Inventors: Chan-Jae Lee, Seoul; Chun-Gyoo Lee; Tae-Young Ko, both of Kyungki-do, all of (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/513,064

(22) Filed: Feb. 24, 2000

(30) Foreign Application Priority Data

Mar. 18, 1999 (KR) ..... 99-9227
Jul. 2, 1999 (KR) ..... 99-26436

(51) Int. Cl.[7] ..... H01J 1/62
(52) U.S. Cl. ..... 313/496; 313/495; 313/310
(58) Field of Search ..... 313/495, 496, 313/309, 336, 351

(56) References Cited

U.S. PATENT DOCUMENTS 4,940,916 A 7/1990 Borel et al. ..... 313/306
5,726,530 A * 3/1998 Peng ..... 313/495
6,259,198 B1 * 7/2001 Yanagisawa et al. ..... 313/495

FOREIGN PATENT DOCUMENTS

JP 9-92131 4/1997

* cited by examiner

*Primary Examiner*—Vip Patel
*Assistant Examiner*—Ken A Berck
(74) *Attorney, Agent, or Firm*—Christie, Parker & Hale, LLP

(57) ABSTRACT

A field emission display includes first and second substrates spaced apart from each other with a predetermined distance. The top surface of the first substrate faces the bottom surface of the second substrate. A main cathode electrode layer is disposed on the top surface of the first substrate. A gate electrode layer is arranged over the main cathode electrode layer such that the gate electrode layer and the main cathode electrode layer intersect to be orthogonal to each other. The intersection of the gate electrode layer and the main cathode electrode layer becomes to be unit pixel areas. The gate electrode layer has a plurality of holes at the unit pixel areas. A resistance layer is formed on the main cathode electrode layer while being positioned at the unit pixel areas. A first insulation layer with one or more contact holes is formed on the resistance layer. A subsidiary cathode electrode layer is formed on the first insulation layer while contacting the resistance layer through the contact holes. A second insulation layer is formed on the subsidiary cathode electrode layer. The gate electrode layer is formed on the second insulation layer. A field emitter with a plurality of electron emitting members is positioned within the holes of the gate electrode layer while resting on the subsidiary cathode electrode layer. An anode electrode layer is formed on the bottom surface of the second substrate with a predetermined electrode pattern. A phosphor layer is formed on the anode electrode layer.

13 Claims, 9 Drawing Sheets

FIELD EMISSION DISPLAY

BACKGROUND OF THE INVENTION (a) Field of the Invention

The present invention relates to a field emission: display and, more particularly, to a field emission display which maximizes electron emission density of a field emitter while minimizing damage of the field emitter due to over-current.

(b) Description of the Related Art

Generally, field emission displays (FEDs) are display devices where electrons are liberated from an emitter on a cathode by quantum mechanical tunneling and impinge upon phosphors on an anode, thereby producing a predetermined screen image.

A micro-tip based field emitter is typically used for such an emitter for the field emission display. The field emission display includes a faceplate anode substrate with a bottom surface, and a backplate cathode substrate with a top surface facing the bottom surface of the faceplate substrate. The top surface of the backplate substrate is sequentially overlaid with a cathode electrode layer and a gate electrode layer such that the electrode layers intersect orthogonal to each other. An insulation layer is interposed between the cathode electrode layer and the gate electrode layer to electrically insulate them from each other. The portions of the insulation layer and the gate electrode layer where the cathode electrode layer and the gate electrode layer intersect are etched to thereby form a large number of holes for accommodating micro-tips for the emitter. Meanwhile, the bottom surface of the faceplate substrate is sequentially overlaid with an anode electrode layer and a phosphor layer.

In the above-structured field emission display, electric field is formed around the micro-tip emitter due to voltage difference applied to the cathode electrode layer and the gate electrode layer. Electrons are liberated from the micro-tips under the influence of the electric field, and accelerated toward the phosphor layer by high voltage applied to the anode electrode layer, thereby striking the phosphors on the phosphor layer.

In the meantime, under the application of over-current, the micro-tips for the emitter are liable to breakdown, causing device failure. In this connection, several techniques for protecting the emitter have been suggested.

For instance, U.S. Pat. No. 4,940,916 discloses a technique of interposing a resistance layer between the cathode electrode layer and the micro-tips for the field emitter. The resistance layer functions as a butter resistor for protecting the micro-tips.

However, in such a technique, the resistance layer should be formed on the entire surface of the cathode electrode layer, and this structure makes it difficult to control suitable resistance degree of the resistance layer for preventing breakdown of the emitter.

Japanese Patent No. 9-92131 discloses another technique of protecting the micro-tip emitter. As shown in FIGS. 9 and 10, non-electrode portions 7 are formed in the cathode electrode layer 5, and an inner island-like electrode 9 is formed within each non-electrode portion 7. The cathode electrode layer 5, the non-electrode portions 7 and the island-like electrodes 9 are covered by a resistance layer 11. A plurality of cone-shaped micro-tips are arranged on the resistance layer 11 such that they are placed within the area corresponding to the location of each island-like electrode 9.

In the above structure, the density of current applied to the emitter 13 can be controlled through the resistance layer 11.

Furthermore, the resistance degree of the resistance layer 11 can be controlled by; varying the distance between the cathode electrode layer 5 and the island-like electrode 9.

However, it is difficult to employ the above-structured field emission display for use in the large-sized high resolution display device application. When the width of the cathode electrode layer is reduced to realize high resolution screen image, the width of the island-like electrode 9 is reduced as much, and resistance at that position increases. In this structure, it naturally follows that the number of the micro-tips 13 to be formed over the narrowed island-like electrode 9 should be limited, and high resolution of the display device cannot be realized. In addition, when the display device becomes large-sized, the portion of the narrowed island-like electrode 9 with increased resistance is lengthened so that the desired resistance degree cannot be obtained.

SUMMARY OF THE INVENTION

It is an object of the present invention to provide a field emission display which can effectively protect a field emitter from entering into breakdown while bearing sufficient display area for realizing high resolution.

It is another object of the present invention to provide a field emission display which can prevent voltage drop at a cathode electrode layer with an increased length.

These and other objects may be achieved by a field emission display including first and second substrates spaced apart from each other with a predetermined distance. The top surface of the first substrate faces the bottom surface of the second substrate. A main cathode electrode layer is disposed on the top surface of the first substrate. A gate electrode layer is arranged over the main cathode electrode layer such that the gate electrode layer and the main cathode electrode layer intersect to be orthogonal to each other. The intersection of the gate electrode layer and the main cathode electrode layer becomes to be unit pixel areas. The gate electrode layer has a plurality of holes at the unit pixel areas.

A resistance layer is formed on the main cathode electrode layer while being positioned at the unit pixel areas. A first insulation layer with one or more contact holes is formed on the resistance layer. A subsidiary cathode electrode layer is formed on the first insulation layer while contacting the resistance layer through the contact holes. A second insulation layer is formed on the subsidiary cathode electrode layer. The gate electrode layer is formed on the second insulation layer. A field emitter with a plurality of electron emitting members is positioned within the holes of the gate electrode layer while resting on the subsidiary cathode electrode layer.

An anode electrode layer is formed on the bottom surface of the second substrate with a predetermined electrode pattern. A phosphor layer is formed on the anode electrode layer.

The main cathode electrode layer is provided with a plurality of linear electrodes, a plurality of non-electrode portions formed at each linear electrode, and one or more island-like electrodes positioned within each non-electrode portion while being spaced apart from the linear electrode with a predetermined distance.

Alternatively, the island-like electrodes may be formed on the subsidiary cathode electrode layer with a suitable structure.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1:
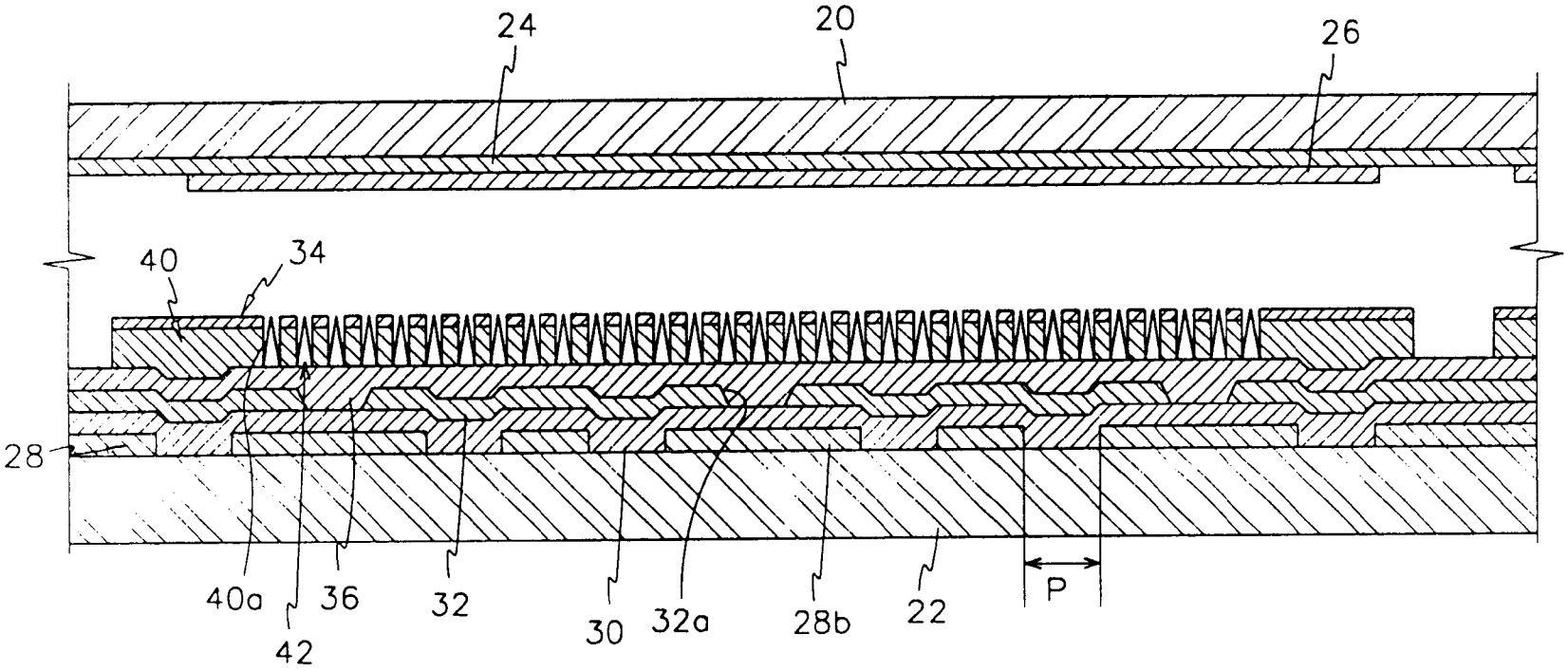
FIG. 1 is partial side elevation view of a field emission display according to a first preferred embodiment of the present invention.
Figure 2:
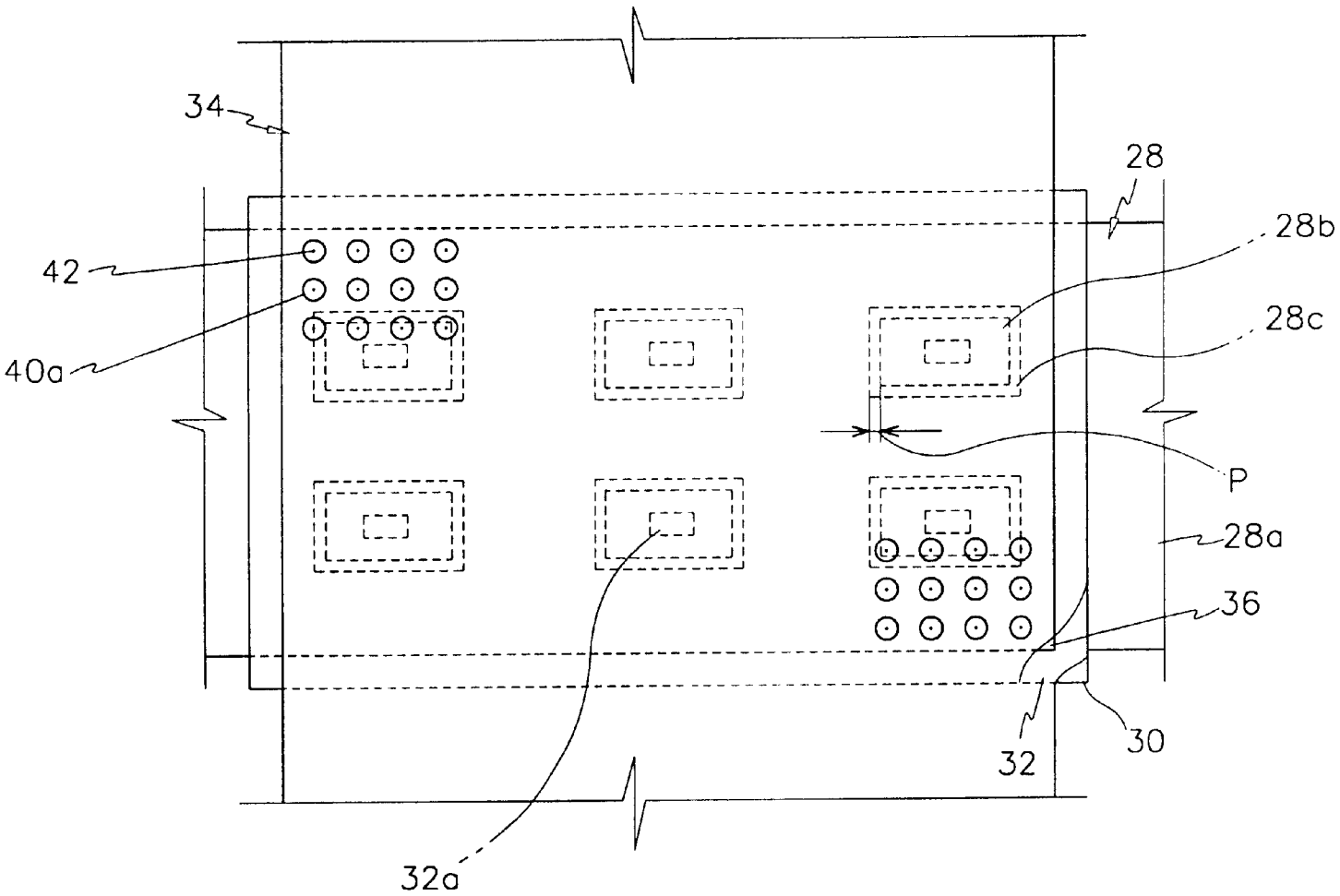
FIG. 2 is a partial plan view of the field emission display shown in FIG. 1.
Figure 3:
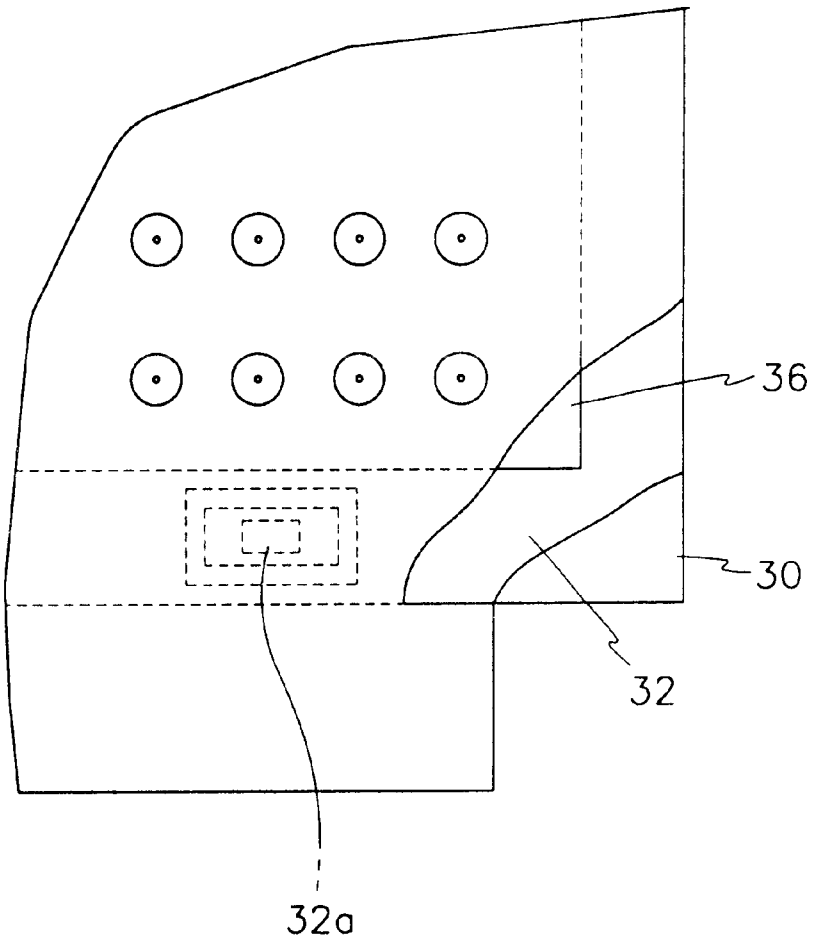
FIG. 3 is another partial plan view of the field emission display shown in FIG. 1.

FIG. 1 is a partial side elevation view of a field emission display according to a first preferred embodiment of the present invention, and FIGS. 2 and 3 are partial plan views of the field emission display shown in FIG. 1. As shown in FIG. 1, the field emission display includes a faceplate substrate 20 with a bottom surface, and a backplate substrate 22 spaced apart from the faceplate substrate 20 with a predetermined distance. The backplate substrate 22 has a top surface facing the bottom surface of the faceplate substrate 20.

An anode electrode layer 24 with a plurality of linear electrodes is disposed on the bottom surface of the faceplate substrate 20, and a phosphor layer 26 is in turn formed on the anode electrode layer 24 such that R, G and B phosphors are patterned on the linear electrodes.

A main cathode electrode layer 28 with another plurality of linear electrodes 28*a* is disposed on the top surface of the backplate substrate 22. As shown in FIG. 2, each linear electrode 28*a* of the main cathode electrode layer 28 is formed with one or more island-like electrodes 28*b*. In the triode structure, a gate electrode layer 34 with still another plurality of linear electrodes is formed over the main cathode electrode layer 28 such that the linear electrodes of the former 34 are arranged to be orthogonal to those 28*a* of the latter 28. The intersection of the main cathode electrode layer 28 and the gate electrode layer 34 becomes to be unit pixel areas.

In order to form such island-like electrodes 28*b* at the linear electrode 28*a*, non-electrode portions 28*c* are first made at the linear electrode 28*a* by photolithography, and then taken away by etching while leaving behind the island-like electrodes 28*b*. It is preferable that the distance P between the linear electrode 28*a* and the island-like electrode 28*b* is kept to be 5 $\mu$m. Of course, in case the display characteristics of the field emission display are varied, the electrode distance P may be controlled to accommodate such a variation in an appropriate manner.

The main cathode electrode layer 28 is overlaid with a resistance layer 30 and a first insulation layer 32. The resistance layer 30 and the first insulation layer 32 are positioned at the intersection of the main cathode electrode layer 28 and the gate electrode layer 34.

The resistance layer 30 can be obtained by CVD-processing amorphous silicon or spin-coating high-molecular organic material on the main cathode layer 28. It is preferable that the thickness of the resistance layer 30 is approximately 2,500 Å.

The first insulation layer 32 can be obtained by CVD-processing or sputtering $SiO_2$ or SiN on the resistance layer 30. It is preferable that the thickness of the first insulation layer 32 is approximately 1,000 Å.

A subsidiary cathode electrode layer 36 with still another plurality of linear electrodes is formed on the first insulation layer 32 by sputtering indium tin oxide (ITO), Mo, Cr or Nb thereon. The first insulation layer 32 is provided with one or more contact holes 32*a* to electrically connect the resistance layer 30 to the subsidiary cathode electrode layer 36. That is, the subsidiary cathode electrode layer 36 is partially protruded through the contact holes 32*a* of the first insulation layer 32 such that it can contact the resistance layer 30.

As shown in FIG. 2, the contact holes 32*a* of the first insulation layer 32 are positioned inside of the unit pixel areas where the cathode electrode layer 28 and the gate electrode layer 34 intersect. Alternatively, as shown in FIG. 3, the contact holes 32*a* may be positioned outside of the unit pixel areas.

Considering that the first insulation layer 32 may be provided with plural numbers of the contact holes 32*a*, it may be noted that the electrical connection of the resistance layer 30 to the subsidiary cathode electrode layer 36 can be kept to be constant even when over-current is applied to one or some of the contact holes and results in breakdown effects there.

The contact holes 32*a* may be formed with a circular, rectangular or other diagonal shapes. It should be noted that in case the contact holes 32*a* are positioned outside of the unit pixel areas, the subsidiary cathode layer 36 would be structured to take up much space enough to cover the contact holes 32*a* completely.

In case the field emission display has a triode structure with the aforementioned gate electrode layer 34, a second insulation layer 40 is formed between the gate electrode layer 34 and the subsidiary cathode electrode layer 36.

A field emitter 42 with a plurality of micro-pointed tips rests on the subsidiary cathode layer 36 while being disposed within openings 40*a* formed at the second insulation layer 40.

In the above-structured field emission display, the interface between the second substrate 22 and the field emitter 42 is multi-layered so that the resistance degree of the resistance layer 30 can be controlled in an appropriate manner. In this way, possible damage of the field emitter 42 due to over-current can be prevented.

Furthermore, the resistance layer 30 and the subsidiary cathode electrode layer 36 are structured to electrically contact each other so that the micro-tips for the field emitter 42 can be distributed over the entire unit pixel area of the subsidiary cathode electrode layer 36. In this structure, the distribution range of the micro-tips for the field emitter 42 is enlarged so that electron emission density can be elevated, thereby enhancing device resolution.

An additional resistance layer (not shown) may be formed between the subsidiary cathode electrode layer 36 and the second insulation layer 40. In this way, the degree of resistance working in the subsidiary cathode electrode layer 36 and the field emitter 42 can be further controlled.

Figure 4:
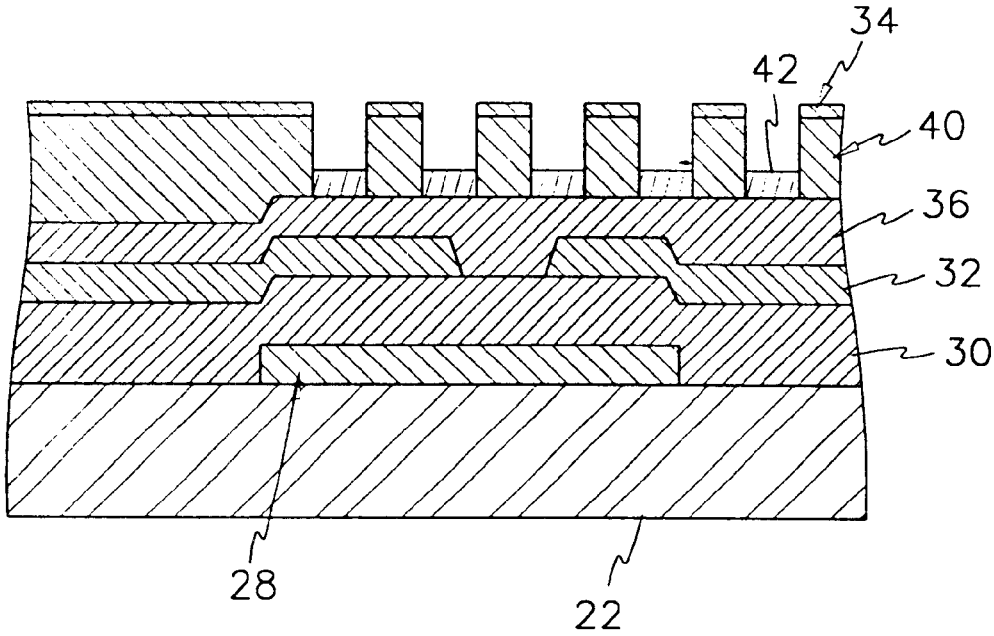
FIG. 4 is a partial side elevation view of a field emission display according to a second preferred embodiment of the present invention.

FIG. 4 is a partial side elevation view of a field emission display according to a second preferred embodiment of the present invention. In this preferred embodiment, other components of the field emission display are the same as those related to the first preferred embodiment except that the field emitter 42 is film-typed with a relatively broad electron emission area.

Figure 5:
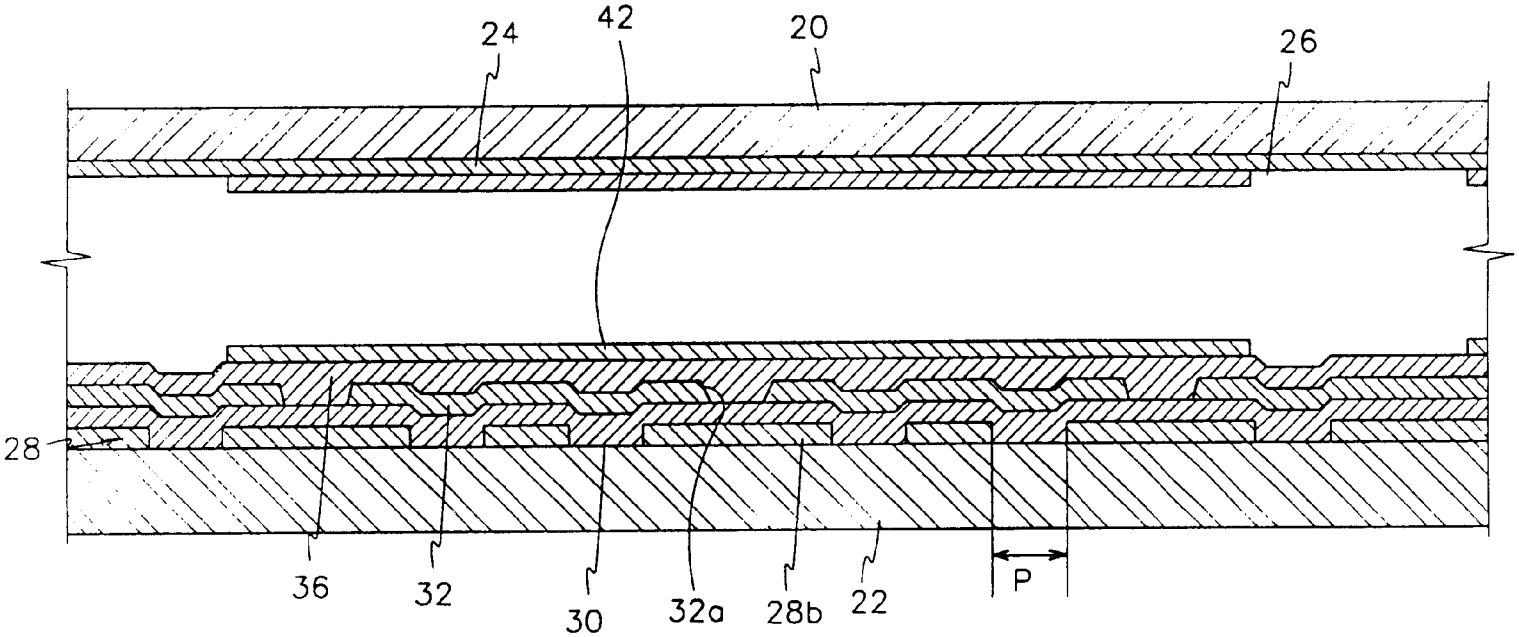
FIG. 5 is a partial side elevation view of a field emission display according to a third preferred embodiment of the present invention.

FIG. 5 is a partial side elevation view of a field emission display according to a third preferred embodiment of the present invention. In this preferred embodiment, other components of the field emission display are the same as those related to the first preferred embodiment except that the triode structure is replaced by a diode structure where-the gate electrode layer 34 and the second insulation layer 40 are absent.

Figure 6:
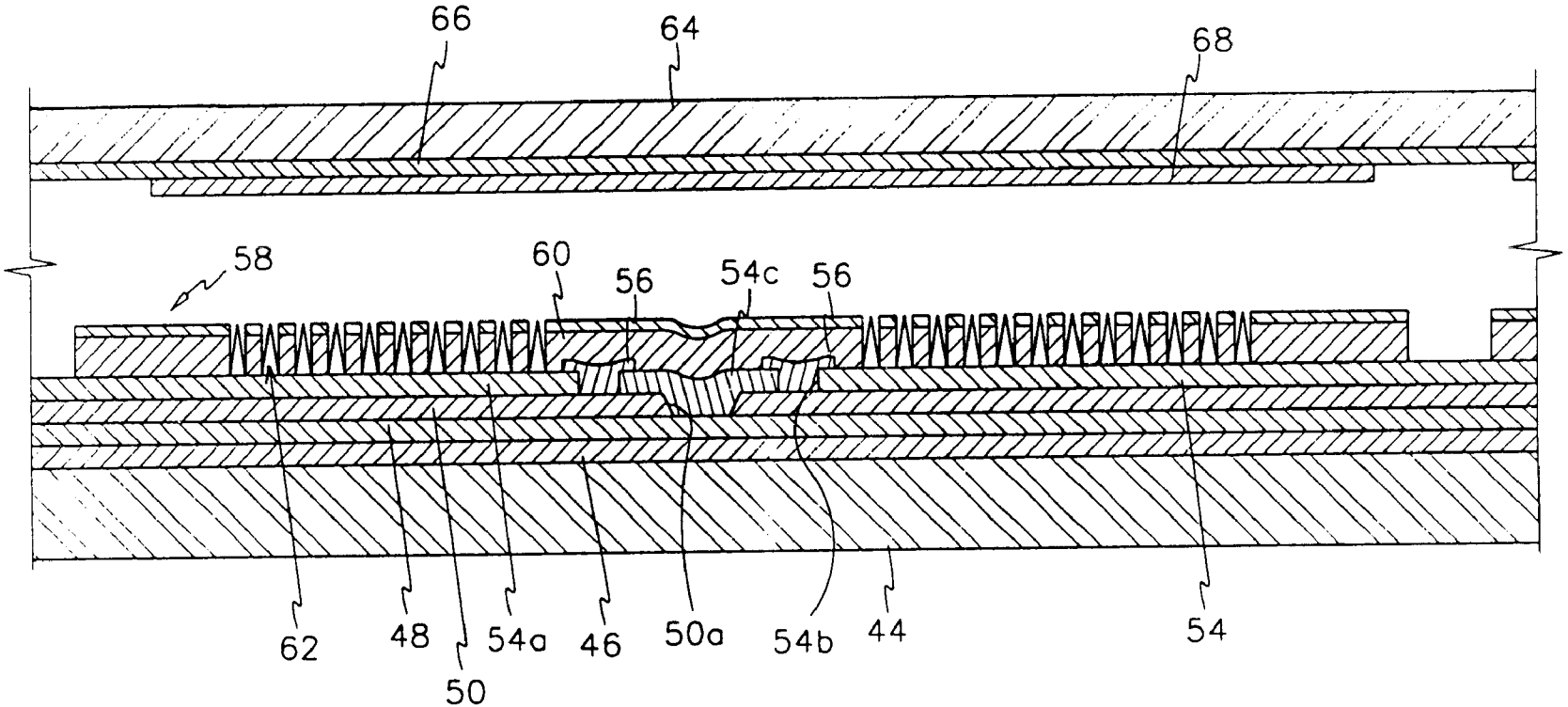
FIG. 6 is a partial side elevation view of a field emission display according to a fourth preferred embodiment of the present invention.

FIG. 6 is a partial side elevation view of a field emission display according to a fourth preferred embodiment of the present invention. As shown in FIG. 6, a main cathode electrode layer 46 with a plurality of linear electrodes is first formed on a backplate substrate 44. In this preferred embodiment, the linear electrode of the main cathode electrode layer 46 does not have any separate island-like electrode.

A first resistance layer 48 is formed on the main cathode electrode layer 46, and a first insulation layer 50 with one or more contact holes 50*a* is in turn formed on the resistance layer 48. Furthermore, a subsidiary cathode electrode layer 54 with another plurality of linear electrodes 54*a* is formed on the first insulation layer 50.

Each linear electrode 54*a* of the subsidiary cathode electrode layer 54 has a plurality of non-electrode portion 54*b*. One or more island-like electrodes 54*c* are formed within the non-electrode portion 54*b* such that they contact the first insulation layer 50 while being spaced apart from the linear electrode 54*a* of the subsidiary cathode electrode layer 54 with a predetermined distance.

The island-like electrode 54*c* is electrically connected to the subsidiary cathode electrode line 54*a*. The electrical connection of the island-like electrode 54*c* to the linear electrode 54*a* of the subsidiary cathode electrode layer 54 is accomplished by a second resistance layer 56 that is formed at the non-electrode portion 54*b* while partially covering the linear electrode 54*a* of the subsidiary cathode electrode layer 54 and the island-like electrode 54*c*.

In the triode structure, the subsidiary cathode electrode layer 54 is sequentially overlaid with a gate electrode layer 58, a third insulation layer 60 and a field emitter 62.

As is in the first preferred embodiment, a faceplate substrate 64 is spaced apart from the backplate substrate 44 with a predetermined distance, and sequentially overlaid with an anode electrode layer 66 and a phosphor layer 68 toward the backplate substrate 44.

In the above-structured field emission display, the resistance degree between the main cathode electrode layer 46 and the field emitter 62 can be controlled by changing the thickness of the first resistance layer 48 and the width of the second resistance layer 56. The width of the second resistance layer 56 can be changed by controlling the distance between the linear electrode 54*a* of the subsidiary cathode electrode layer 54 and the island-shaped electrode 54*c*.

Of course, since the island-like electrode 54*c* is positioned in the subsidiary cathode electrode layer 54, the area of the field emitter 62 may be more or less reduced. However, since the main cathode electrode layer 46 is simply formed with the linear electrodes without any separate structured portion, it can be noted that the display area is still enough.

Alternatively, the field emission display may be diode-structured without the gate electrode layer 58 and the third insulation layer 60. Furthermore, the field emitter 62 may be film-typed with a relatively large electron emission area, and the contact holes 50*a* may be placed inside or outside of the unit pixel area.

Figure 7:
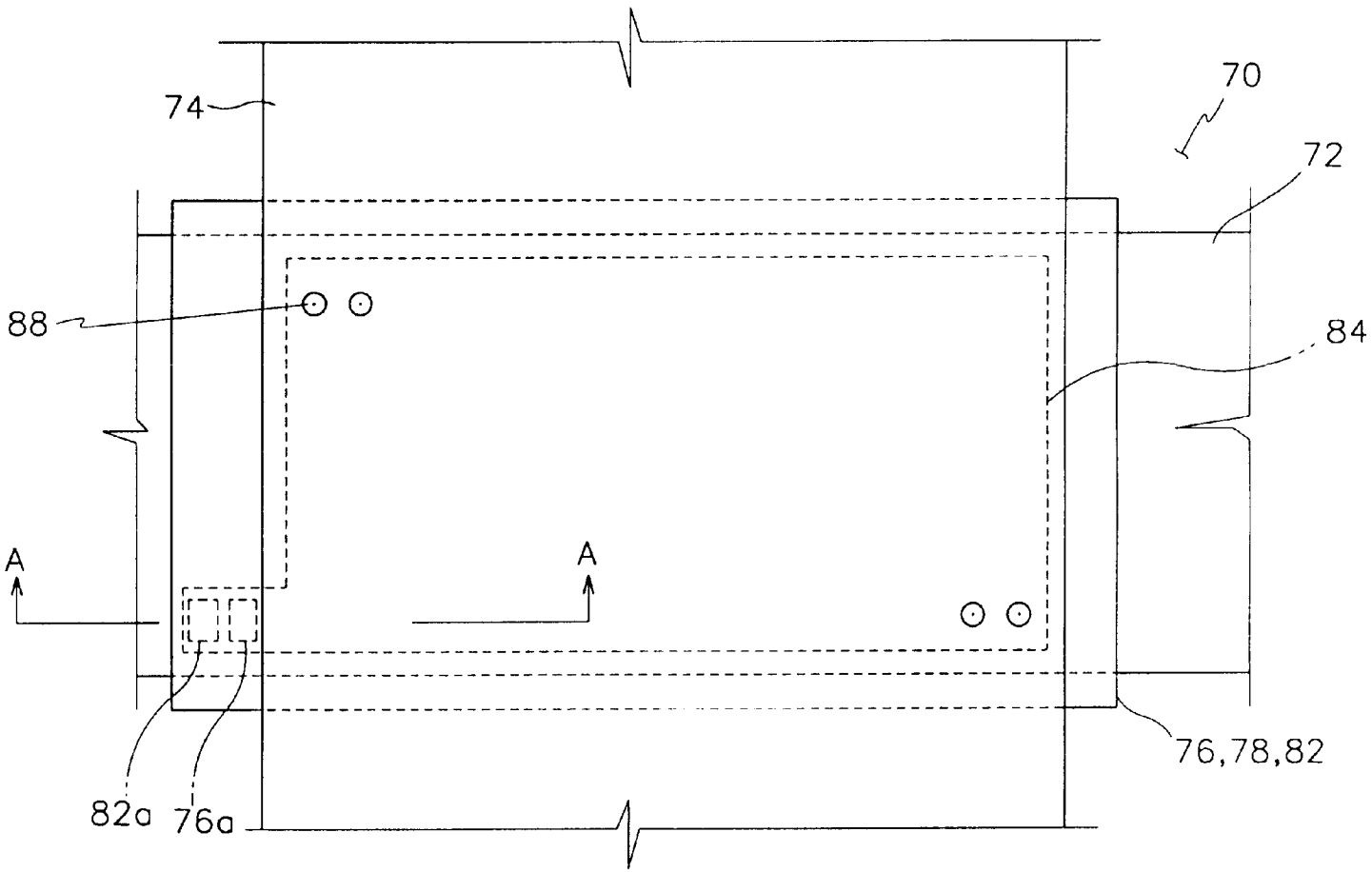
FIG. 7 is a partial side elevation view of a field emission display according to a fifth preferred embodiment of the present invention.
Figure 8:
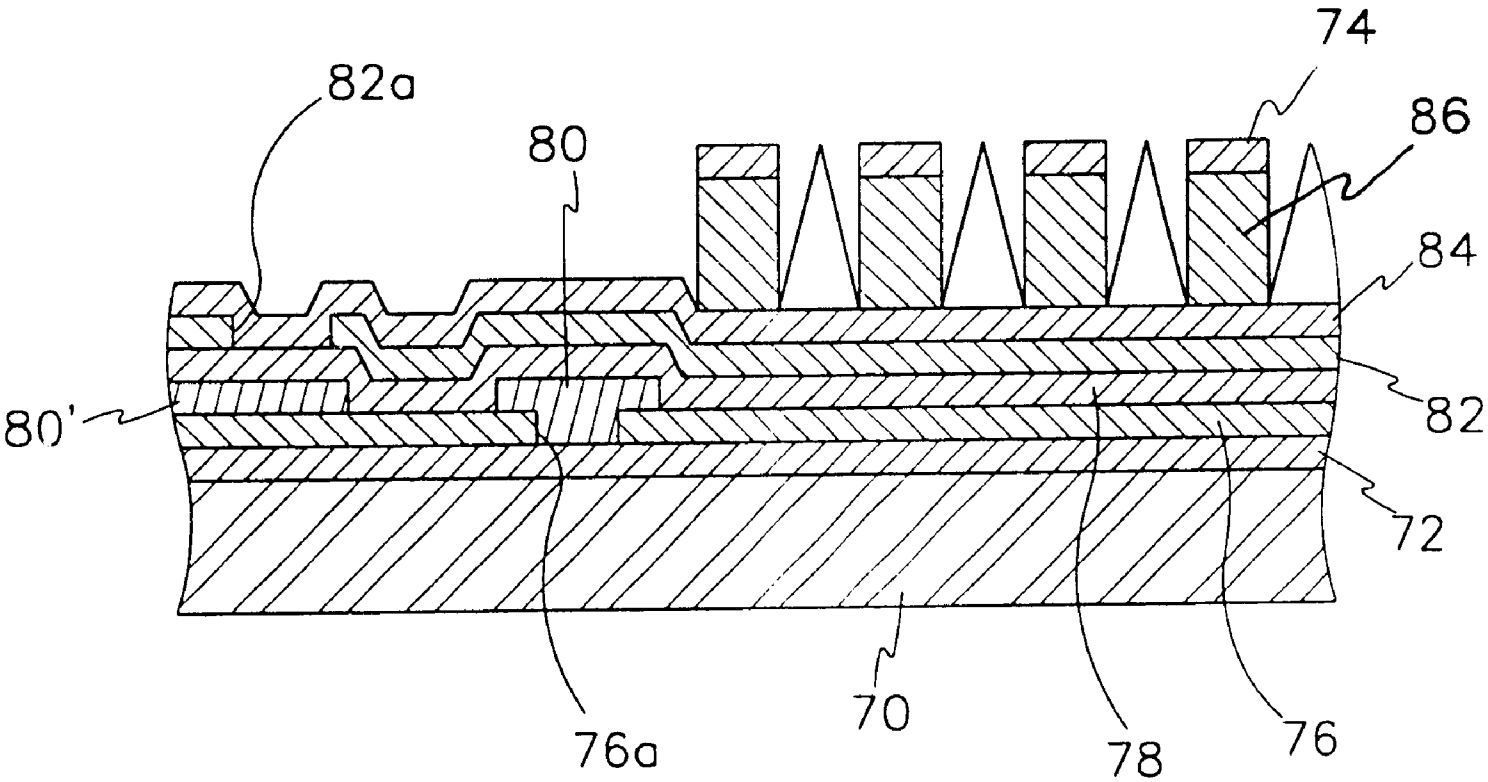
FIG. 8 is a cross sectional view of the field emission display taken along the A—A line of FIG. 7.
Figure 9:
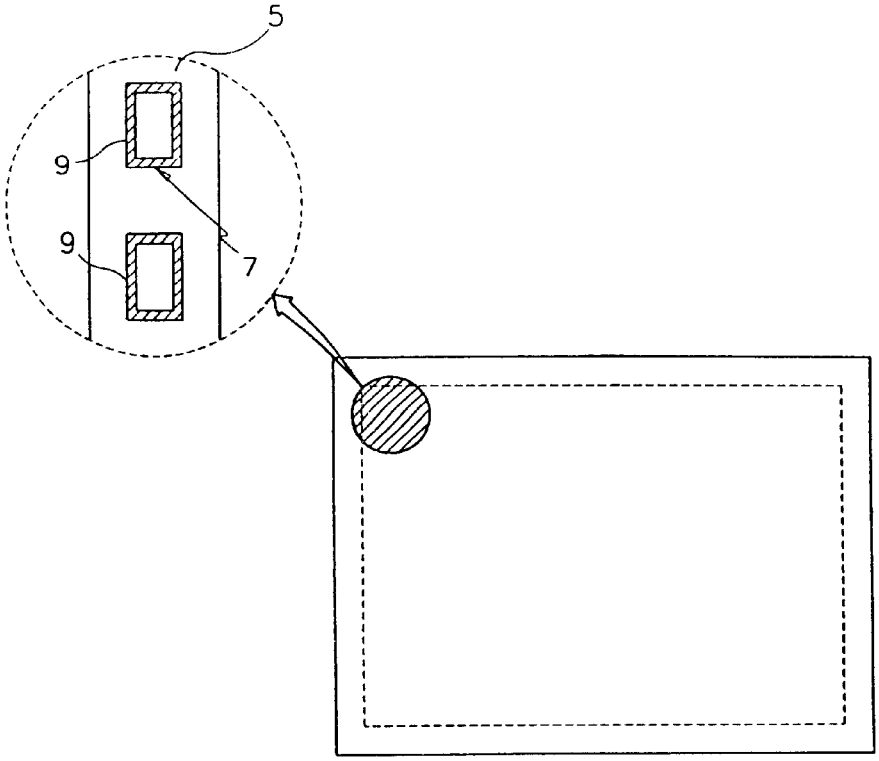
FIG.9 (Prior Art)
FIG. 9 is a plan view of a field emission display according to a prior art.
Figure 10:
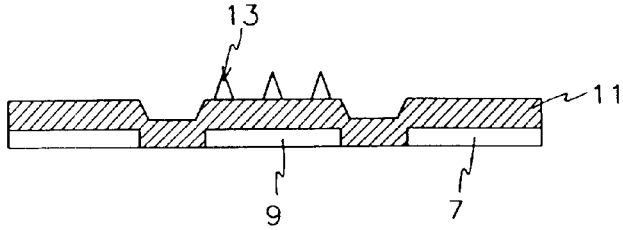
FIG.10 (Prior Art)
FIG. 10 is a partial side elevation view of the field emission display shown in FIG. 9.

FIG. 7 is a partial plan view of a field emission display according to a fifth preferred embodiment of the present invention where the intersection of a main cathode electrode layer and a gate electrode layer is illustrated, and FIG. 8 is a cross-sectional view of the field emission display taken along the A—A line of FIG. 7. In this preferred embodiment, other components of the field emission display are the same as those related to the first preferred embodiment except that the cathode electrode structure is newly made.

A main cathode electrode layer 72 with a plurality of linear electrodes is formed on a backplate substrate 70, and a gate electrode layer 74 with another plurality of linear electrodes is arranged to be orthogonal to the main cathode electrode layer 72. A first insulation layer 76 with one or more connection holes 76*a* is formed on the main cathode electrode layer 72, and a resistance layer 78 is in turn formed on the first insulation layer 76. The connection holes 76*a* of the first insulation layer 76 are to electrically connect the main cathode electrode layer 72 to the resistance layer 78. The connection holes 76*a* are positioned outside of the unit pixel area where the main cathode electrode layer 72 and the gate electrode layer 74 intersect. A first connection electrode 80 is provided in the connection hole 76*a* to electrically connect the cathode electrode layer 72 to the resistance layer 78.

A second insulation layer 82 having one or more contact holes 82*a* is disposed on the resistance layer 78 outside of the unit pixel area, and a subsidiary cathode electrode layer 84 is in turn formed on the second insulation layer 82. A second connection electrode 80' is formed on the first insulation layer 76 under the contact holes 82*a* to electrically connect the subsidiary cathode electrode layer 84 to the main cathode electrode layer 72. The second connection electrode 80' is spaced apart from the first connection electrode 80 with a predetermined distance. It is preferable that the first and second connection electrodes 80 and 80' are formed with indium tin oxide.

The field emission display according to the fifth preferred embodiment is formed with a triode structure where a third insulation layer 86 is formed between the gate electrode layer 74 and the subsidiary cathode electrode layer 84, and micro-tips for a field emitter 88 are arranged within breakthrough holes formed at the third insulation layer 86 and the gate electrode layer 74.

In the above-structured field emission display, a multi-layered structure is formed between the main cathode electrode layer 72 and the subsidiary cathode electrode layer 84 so that large numbers of micro-tips for the field emitter 88 can be arranged on the subsidiary cathode electrode layer 84.

Accordingly, even though the electrode width of the main cathode electrode layer 72 is reduced due to large device area, the micro-tips for the field emitter 88 are uniformly distributed over the entire area of the subsidiary cathode electrode layer 72 so that high resolution of the device can be realized.

Furthermore, the voltage drop due to large electrode length of the main cathode electrode layer 72 can be effectively prevented by controlling the thickness of the multi-layered structure.

As is in the previous preferred embodiments, the field emission display may be diode-structured, and the field emitters 88 may be film-typed with a relatively large electron emission area.

Meanwhile, in the above-described preferred embodiments, it is preferable that the multi-layered structure should be flattened through a separate flattening process. Chemical Mechanical Polishing (CMP) technique that is extensively used in the semiconductor fabricating process is preferably employed for that purpose.

As described above, in the large-sized high resolution display device application, the inventive field emission display can effectively protect a field emitter from entering into breakdown due to over-current while maximizing electron emission density of the field emitter.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A field emission display comprising:

first and second substrates spaced apart from each other, the first substrate having a surface and the second substrate having a surface, the surface of the first substrate facing the surface of the second substrate;

a main cathode electrode layer disposed on the surface of the first substrate;

a gate electrode layer arranged over the main cathode electrode layer such that the gate electrode layer and the main cathode electrode layer intersect orthogonally to each other, the intersection of the gate electrode layer and the main cathode electrode layer being unit pixel areas, the gate electrode layer having a plurality of holes at the unit pixel areas;

a resistance layer formed on the main cathode electrode layer and positioned at the unit pixel areas, wherein at least a portion of the resistance layer is in contact with the surface of the first substrate;

a first insulation layer formed on the resistance layer, the first insulation layer having at least one contact hole;

a subsidiary cathode electrode layer formed on the first insulation layer and contacting the resistance layer through the at least one contact hole of the first insulation layer;

a second insulation layer formed on the subsidiary cathode electrode layer, the gate electrode layer being formed on the second insulation layer;

a field emitter having a plurality of electron emitting members, the electron emitting members of the field emitter being positioned within the holes of the gate electrode layer and positioned on the subsidiary cathode electrode layer;

an anode electrode layer formed on the surface of the second substrate; and a phosphor layer formed on the anode electrode layer.

2. The field emission display of claim 1 wherein the main cathode electrode layer comprises a plurality of linear electrodes, a plurality of non-electrode portions formed at each linear electrode, and at least one island electrode positioned within each non-electrode portion and spaced apart from the linear electrode a predetermined distance.

3. The field emission display of claim 1 wherein the subsidiary cathode electrode layer comprises a plurality of linear electrodes, a plurality of non-electrode portions formed at each linear electrode, and at least one island electrode positioned within each non-electrode portion and spaced apart from the linear electrode, each of the at least one island electrode of the subsidiary cathode electrode layer being electrically connected to its respective linear electrode and the first insulation layer.

4. The field emission display of claim 3 further comprising an additional resistance layer formed at the non-electrode portions while partially covering the linear electrode and the island-like electrode.

5. The field emission display of claim 1 wherein the at least one contact hole is positioned inside of the unit pixel areas.

6. The field emission display of claim 1 wherein the at least one contact hole is positioned outside of the unit pixel areas.

7. The field emission display of claim 1 wherein each electron emitting member of the field emitter is a micro-pointed tip.

8. The field emission display of claim 1 wherein each electron emitting member of the field emitter comprises a film type emitter.

9. The field emission display of claim 2 wherein the island electrode positioned within each non-electrode portion is spaced apart from the linear electrode by a spacing and wherein the resistance layer penetrates the spacing.

10. A field emission display comprising:

first and second substrates spaced apart from each other, the first substrate having a surface and the second substrate having a surface, the surface of the first substrate facing the surface of the second substrate;

a main cathode electrode layer disposed on the surface of the first substrate, wherein the main cathode electrode layer comprises a plurality of linear electrodes, a plurality of non-electrode portions formed at each linear electrode, and at least one island electrode positioned within each non-electrode portion and spaced apart from the linear electrode a predetermined distance;

a resistance layer formed on the main cathode electrode layer and positioned at the unit pixel areas;

a gate electrode layer arranged over the main cathode electrode layer such that the gate electrode layer and the main cathode electrode layer intersect orthogonally to each other, the intersection of the gate electrode layer and the main cathode electrode layer being unit pixel areas, the gate electrode layer having a plurality of holes at the unit pixel areas;

a first insulation layer formed on the resistance layer, the first insulation layer having at least one contact hole;

a subsidiary cathode electrode layer formed on the first insulation layer and contacting the resistance layer through the at least one contact hole of the first insulation layer;

a second insulation layer formed on the subsidiary cathode electrode layer, the gate electrode layer being formed on the second insulation layer;

a field emitter having a plurality of electron emitting members, the electron emitting members of the field emitter being positioned within the holes of the gate electrode layer and positioned on the subsidiary cathode electrode layer;

an anode electrode layer formed on the surface of the second substrate; and a phosphor layer formed on the anode electrode layer.

11. A field emission display comprising:

first and second substrates spaced apart from each other, the first substrate having a surface and the second substrate having a surface, the surface of the first substrate facing the surface of the second substrate;

a main cathode electrode layer disposed on the surface of the first substrate;

a resistance layer formed on the main cathode electrode layer and positioned at the unit pixel areas;

a gate electrode layer arranged over the main cathode electrode layer such that the gate electrode layer and the main cathode electrode layer intersect orthogonally to each other, the intersection of the gate electrode layer and the main cathode electrode layer being unit pixel areas, the gate electrode layer having a plurality of holes at the unit pixel areas;

a first insulation layer formed on the resistance layer, the first insulation layer having at least one contact hole;

a subsidiary cathode electrode layer formed on the first insulation layer and contacting the resistance layer through the at least one contact hole of the first insulation layer, wherein the subsidiary cathode electrode layer comprises a plurality of linear electrodes, a plurality of non-electrode portions formed at each linear electrode, and at least one island electrode positioned within each non-electrode portion and spaced apart from the linear electrode, each of the at least one island electrode of the subsidiary cathode electrode layer being electrically connected to its respective linear electrode and the first insulation layer;

a second insulation layer formed on the subsidiary cathode electrode layer, the gate electrode layer being formed on the second insulation layer;

a field emitter having a plurality of electron emitting members, the electron emitting members of the field emitter being positioned within the holes of the gate electrode layer and positioned on the subsidiary cathode electrode layer;

an anode electrode layer formed on the surface of the second substrate; and a phosphor layer formed on the anode electrode layer.

12. The field emission display of claim 11 further comprising an additional resistance layer formed at the non-electrode portions while partially covering the linear electrode and the island-like electrode.

13. A field emission display comprising:

first and second substrates spaced apart from each other, the first substrate having a surface and the second substrate having a surface, the surface of the first substrate facing the surface of the second substrate;

a main cathode electrode layer disposed on the surface of the first substrate;

a gate electrode layer arranged over the main cathode electrode layer such that the gate electrode layer and the main cathode electrode layer intersect orthogonally to each other, the intersection of the gate electrode layer and the main cathode electrode layer being unit pixel areas, the gate electrode layer having a plurality of holes at the unit pixel areas;

a resistance layer formed on the main cathode electrode layer and positioned at the unit pixel areas;

a first insulation layer formed on the resistance layer, the first insulation layer having at least one contact hole, wherein the at least one contact hole is positioned outside of the unit pixel areas;

a subsidiary cathode electrode layer formed on the first insulation layer and contacting the resistance layer through the at least one contact hole of the first insulation layer;

a second insulation layer formed on the subsidiary cathode electrode layer, the gate electrode layer being formed on the second insulation layer;

a field emitter having a plurality of electron emitting members, the electron emitting members of the field emitter being positioned within the holes of the gate electrode layer and positioned on the subsidiary cathode electrode layer;

an anode electrode layer formed on the surface of the second substrate; and a phosphor layer formed on the anode electrode layer.

* * * * *